US006379183B1

(12) United States Patent
Ayres et al.

(10) Patent No.: US 6,379,183 B1
(45) Date of Patent: Apr. 30, 2002

(54) ADAPTER USABLE WITH AN ELECTRONIC INTERCONNECT FOR HIGH SPEED SIGNAL AND DATA TRANSMISSION

(75) Inventors: Daniel J. Ayres, Warren; William Q. Law, Beaverton, both of OR (US)

(73) Assignee: Tektronix, Inc., Beaverton, OR (US)

( * ) Notice: Subject to any disclaimer, the term of this patent is extended or adjusted under 35 U.S.C. 154(b) by 0 days.

(21) Appl. No.: 09/718,313

(22) Filed: Nov. 21, 2000

Related U.S. Application Data

(60) Provisional application No. 60/193,622, filed on Mar. 31, 2000.

(51) Int. Cl.[7] ..... H01R 9/05
(52) U.S. Cl. ..... 439/578
(58) Field of Search ..... 439/578, 63, 289, 439/347, 607, 609

(56) References Cited

U.S. PATENT DOCUMENTS 4,008,941 A * 2/1977 Smith ..... 439/358
4,326,769 A * 4/1982 Dorsey et al. ..... 439/21
5,234,353 A * 8/1993 Scholz et al. ..... 439/289
5,439,394 A * 8/1995 Ikeda ..... 439/675
5,454,734 A * 10/1995 Eggert et al. ..... 439/578

* cited by examiner

*Primary Examiner*—Tulsidas Patel
(74) *Attorney, Agent, or Firm*—William K. Bucher

(57) ABSTRACT

An adapter for an electronic interconnect assembly has a high speed coaxial interconnect for a coaxial transmission line having a central signal conductor and a surrounding shield conductor. The coaxial interconnect has a male side and a female side, with the female side including a shield sleeve having a chamber that receives a male shield contact on the male side. The shield sleeve has a contact with a compliant portion that flexibly grips the male shield contact. A mechanical alignment facility portion selected from a pair of alignment facility portions including a closely mating pocket and body that has one of the male side or female side of the coaxial interconnect. An electrical signal connector is electrically coupled to the selected male or female of the coaxial interconnect.

13 Claims, 10 Drawing Sheets

ADAPTER USABLE WITH AN ELECTRONIC INTERCONNECT FOR HIGH SPEED SIGNAL AND DATA TRANSMISSION

CROSS-REFERENCE TO RELATED APPLICATION

This application claims the benefit of the U.S. Provisional Application No. 60/193,622, filed Mar. 31, 2000.

FIELD OF THE INVENTION

The invention relates to electronic interconnects, and more particularly to an adapter usable with interconnects for high speed signal transmission and control thereof.

BACKGROUND AND SUMMARY OF THE INVENTION

Electronic test and measurement instrumentation is used to test electronic circuitry and devices. Typically, an instrument such as a digital analyzer or oscilloscope is used to test a device under test by contacting the device with an electronic or optical probe connected to the instrument via a cable. A connector on the end of the cable is plugged into a receptacle on the face of the instrument, so that high frequency signals are carried from circuitry on the probe to circuitry in the instrument.

In addition to the primary high frequency signal carried on the cable, other data signals may be carried between the probe and the instrument, such as to provide power and control signals to the probe, or to enable the instrument to actively monitor the high frequency signal only at selected times. Such systems use multiple contact connectors, with several data contacts adjacent a coaxial connector on the instrument/probe interconnect. Existing systems commonly use BNC connectors for the high frequency cable, with a connector housing on the cable supporting several pogo pins extending toward conductive lands on the instrument. To secure the cable, and to provide alignment, BNC connectors have proven effective. Some sampling oscilloscopes and other devices use SMA connectors with a separately connected bus for power and data control signals.

Backward compatibility is an issue for measurement instruments that have standard BNC or SMA type connectors without the power and data contacts. For example, Tektronix, Inc., Beaverton Oreg., manufactures active FET probes, such as the P6205 and P6217, that have multiple contact connectors adjacent to a BNC coaxial connector. To allow this type of probe to be used with a measurement instrument without such an interface, Tektronix manufactures and sells an 1103 TEKPROBE® Power Supply that allows those probes with power and data line contacts to be used with measurement instruments without such facilities. The 1103 TEKPROBE® Power Supply has a first interface connector mounted on the power supply that has a BNC type connector and adjacent contacts compatible with probes having the power and data contacts. A second standard BNC type connector is also mounted on the power supply that has its center conductor coupled to the center conductor of the first BNC type connector. The power supply further has voltage offset potentiometers and on/off switches. A power cable provides power to the power supply. The BNC/contact connector of the probe is connected to the first interface connector and a coaxial cable fitted with BNC type connectors is connected to the second BNC type connector and to the measurement instrument input BNC type connector. Voltage power to the probe is provided by the 1103 power supply as well as probe offset control voltage. The power supply, however, does not provide data stored in the probe to the measurement instrument nor does the instrument control the probe.

BNC interconnects employ rigid sleeves on each side that telescopically mate with each other to limit angular disposition of the cable connector from the chassis mounted connector. Robust mechanical support is important because probe cables may have heavy housings at the connector end to house electronic circuitry. In addition, BNC connectors have a bayonet connection system that provides rotational alignment of the connector housing, and which may be used to prevent unwanted extraction. While effective in some high frequency ranges, BNC connectors degrade signals for frequencies above about 1–3 GHz, depending on system demands and circuitry design.

Therefore, alternative high frequency tolerant connectors are used to insure signal integrity for frequencies above this range. Threaded connectors of some types such as the SMA standard can provide adequate high frequency performance (~12–20 GHz), but threaded connectors are not suited to uses with extra data connections, due to the connector housing and data contacts preventing access needed to rotate the threaded connector portion. A push-on or blind mate connector such as the BMA standard provides suitable high frequency performance, and avoids the incompatibility of threaded connectors with surrounding data connector housings.

However, BMA connectors are susceptible to damage when angularly disposed with more than a moderate force and do not provide any latching or retention mechanism. The shield or ground contact on a female portion of a BMA connector consists of a cylindrical chamber having an interior side wall lined by tiny leaf springs that conform to an inserted male shield contact. This conformity and flexibility provides the high frequency performance, even with slight angular misalignment. However, the delicate leaf spring contacts can be damaged by moderate angular forces on the connector, making a BMA connector unsuitable for labs where a protruding connector may be bumped or weighed down.

The embodiments disclosed herein overcome these limitations by providing an electronic interconnect assembly with a high speed coaxial interconnect for a coaxial transmission line having a central signal conductor and a surrounding shield conductor. The coaxial interconnect has a male side and a female side, with the female side including a shield sleeve having a chamber that receives a male shield contact on the male side. The shield sleeve has a contact with a compliant portion that flexibly grips the male shield contact. A mechanical alignment facility includes a closely mating pocket and body, each attached to a respective male or female side of the interconnect. Additional data and power connectors may be included with the pocket and body. To provide backward compatibility to measurement instruments not having such an interconnect assembly and to provide calibration facility for probes having such an interconnect assembly, a power and data interface adapter provides, at a minimum, power to the measurement probe and can also provide probe related data to and from the measurement instrument.

DETAILED DESCRIPTION OF A PREFERRED EMBODIMENT

Figure 1:
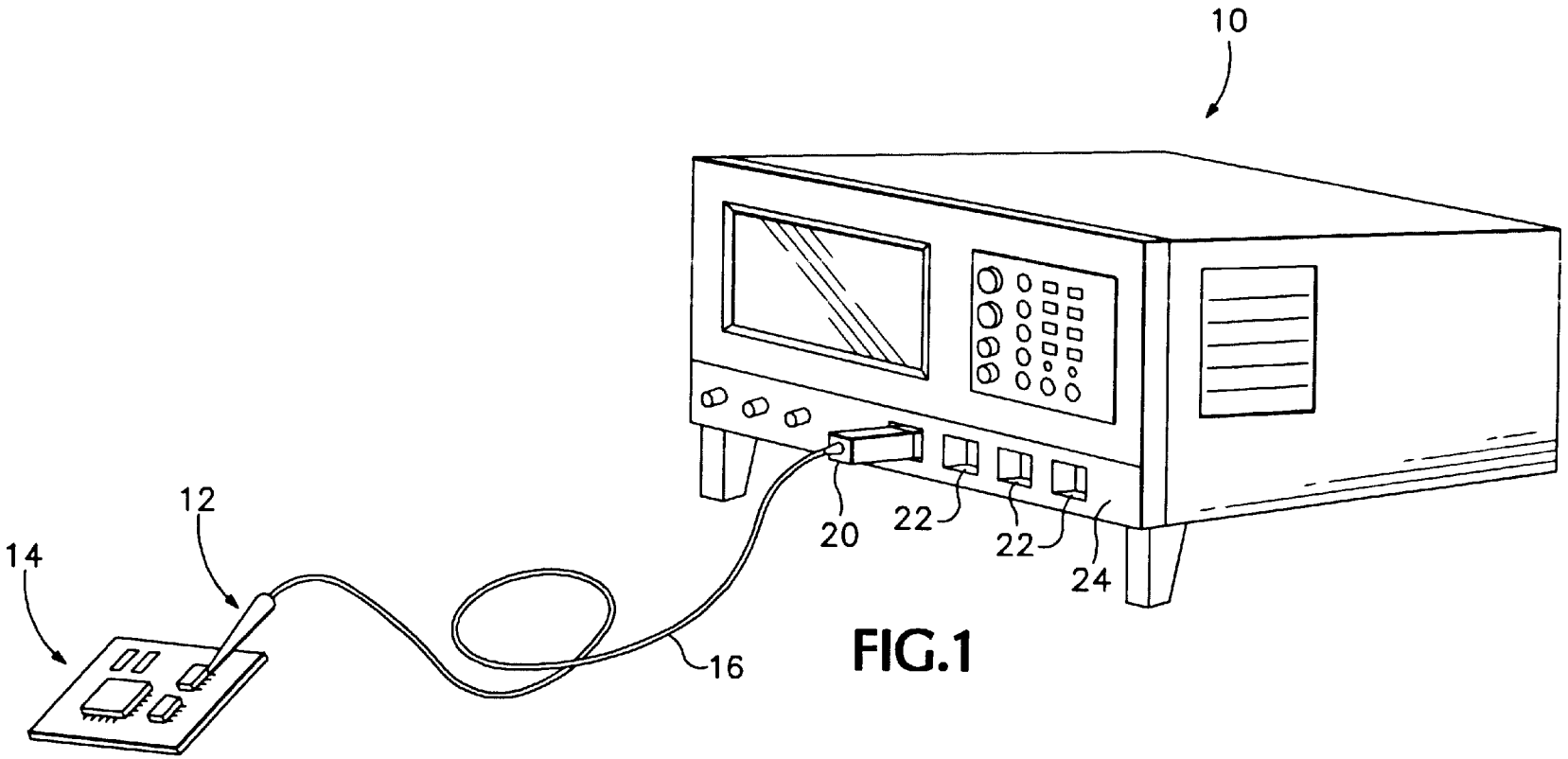
FIG. 1 is a perspective view of an instrument and attached probe according to a preferred embodiment of the invention.

FIG. 1 shows an electronic instrument such as a digital oscilloscope 10 having a connected probe 12 for testing a circuit or device under test 14. The probe includes a cable 16 extending to a probe interconnect housing 20. The cable preferably includes a single coaxial wire having a central signal conductor and a surrounding ground or shield conductor. The cable further includes a multi-line bus for transmitting control signals and power between the probe and the instrument. The housing 20 is removably connected to one of several interconnect receptacles 22 on the front panel 24 of the instrument, and may contain circuitry needed to provide a connection from the cable to the instrument.

Figure 2:
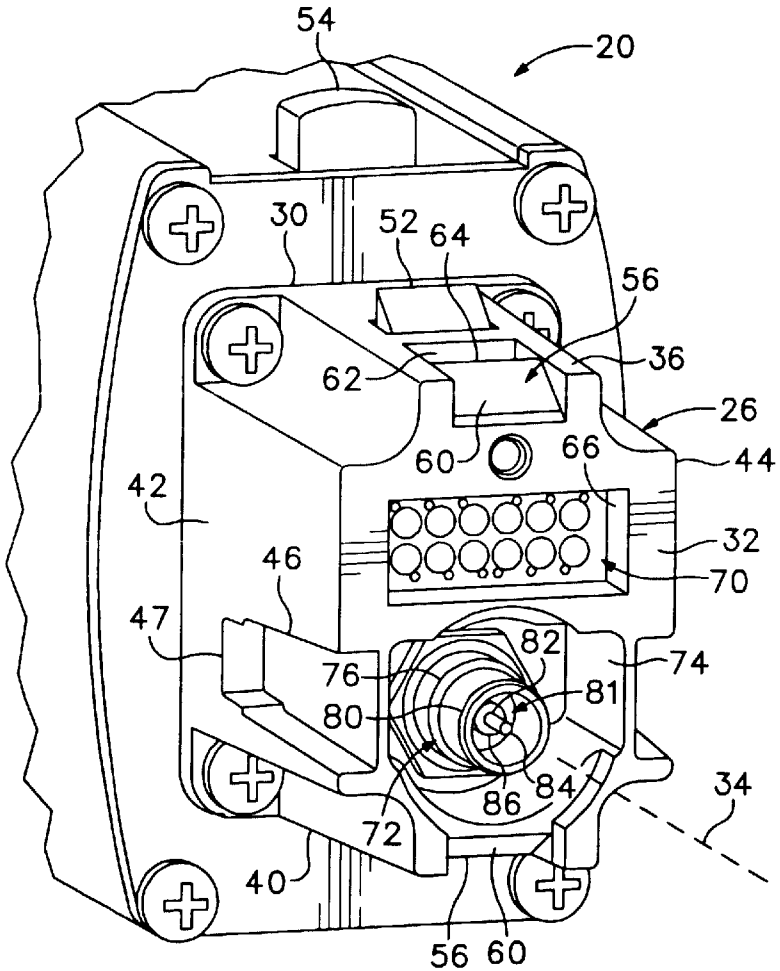
FIG. 2 is perspective view of a probe interconnect according to the embodiment of FIG. 1.

FIGS. 2, 3, 4 and 5 illustrate the mechanical elements implementing the electronic interconnect assembly used in the adapter of the present invention. As shown in FIG. 2, the probe interconnect housing is terminated with an interconnect body 26 that includes electrical connectors for an effective high speed signal and data transmission, and structural alignment features for a secure and aligned mechanical connection to the instrument. The body is a moderately elongated rigid member preferably formed of a rugged material such as nickel plated zinc, die cast aluminum or the like. The body 26 has a trailing face 30 connected to the probe connect housing 20, and a parallel leading face or nose 32 facing the opposite direction, normal to a connector axis 34. The remaining upper wall 36, lower wall 40, and sidewalls 42, 44 give the body a roughly rectangular cross section that minimally varies over the length of the body between the leading and trailing faces, except for features as noted below. To facilitate manufacturing by a casting process, and to provide a tightly mating mechanical connection, the body is tapered to be slightly smaller at the nose 32.

The body 26 includes an alignment notch 46 on each sidewall 42, 44. Each notch has an elongated trapezoidal profile extending from the lead face 32 and extends parallel to the axis 34. The distal end of each notch 46 includes a shouldered guide 47 that is manufactured to close size tolerances so that it closely fits the ends of corresponding keys as will be discussed below. The notches 46 are offset from the horizontal center line of the body 26 to prevent the insertion of the body 26 rotated 180 degrees out of position in the interconnect receptacles 22. The body 26 further includes alignment keys 50, best seen in FIG. 4, on the upper and lower walls 36, 40 that is manufactured to close size tolerances so that it closely fits the ends of corresponding notches as will be discussed below. The shouldered guides 47 and the alignment keys 50 are registered with respect to the nose face 32 such that the guides and keys mate with the corresponding keys and notches at the same time.

The upper surface 36 of the body defines an aperture through which a spring loaded cam lock 52 protrudes. The cam lock is sloped from a level flush with the surface 36 at a leading edge, to a protruding trailing edge. A lock button 54 extending from the housing 20 is mechanically engaged to the lock so that pressing the button retracts the lock into the body to allow disconnection of the connector as will be discussed below.

The upper and lower surfaces 36, 40 include opposed and symmetrically positioned latch ramps 56. Each ramp has a sloped leading ramp surface 60 and a sloped trailing ramp surface 62 that rise to meet at a ridge or apex 64, which is slightly rounded. The ramps are recessed into the surfaces, so that the apex does not protrude above the surface. Each apex defines a line parallel to the surface 36, 40 in which the ramp is defined, and parallel to the nose surface 32 of the body. The ramp and apex surfaces are preferably formed with a smooth or polished surface finish to reduce wear during latching operations discussed below.

The face 32 of the body defines openings for two different electrical connectors. A first opening 66 provides access to a printed circuit board 70 mounted inside a chamber defined by the body and having a contact face accessible through the opening 66. The board 70 has an array of exposed conductive lands that are connected to circuitry in the housing 20 and/or to the probe. Some of the lands may be connected in a pattern electrically identifiable to a counterpart connector contacting the lands as will be discussed below. This option permits the instrument to identify a proper probe connector, even if the data lands are not connected to the probe or other circuitry, such as in less sophisticated but compatible probes. Alternately, the probe circuitry may have an EPROM or other non-volatile device to provide identification features.

A male side 72 of a standard BMA or blind mate connector, such as manufactured and sold by M/A-Com Division of Amp, Inc., Lowell, Mass., is mounted in a recess 74 defined in the body, and extends parallel to the axis 34. The BMA male side includes a shield sleeve portion 76 having a tapered exterior portion 80 at the free end, which extends to a level slightly recessed below the face 32 to prevent damage to the connector. A central signal conductor 81 has a base portion 82, and an extending free end portion 84 coaxial with the shield sleeve portion. The free end portion 84 has a narrower diameter than the base portion, providing a shoulder 86 facing the leading direction. The free end of the conductor 81 is recessed below the shield portion 76, to prevent damage and to ensure that the shield is connected when the signal conductor makes and breaks contact as will be discussed below.

Figure 3:
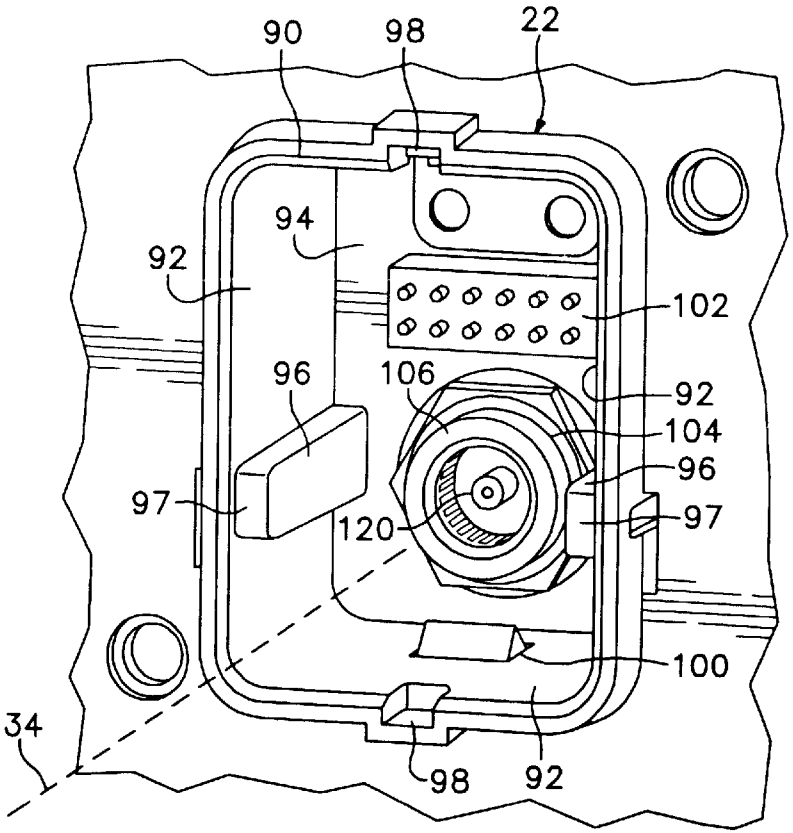
FIG. 3 is perspective view of a chassis interconnect according to the embodiment of FIG. 1.

FIG. 3 shows the instrument mounted receptacle 22 which may be a rigid plastic body, die cast aluminum or the like that forms the female side of the connector, and which receives the probe connector body 26. The receptacle is a pocket or box-shaped body having an open side facing away from the instrument front panel 24, and an open side facing a floor panel 94, essentially providing a tube of rectangular cross section. The receptacle 22, shown more clearly in FIG. 4, has retention nut channels 170 formed therein with each channel having a bore 172. A retention nut 174 is held in each of the channels 170 with the threaded bore of the nut aligned with the corresponding channel bore 172. The panel 94 is preferably a stamped metal sheet that is penetrated only to the extent needed to provide fastener holes and electrical connector holes, to avoid EMI leakage. Threaded bolts (not shown) are passed through the fastener holes and screw onto the retention nuts 174 to secure the receptacle 22 to the front panel 24.

The receptacle 22 has a rim 90 that protrudes from the panel 24, and has sidewalls 92 extending to the floor 94 recessed well below the rim and the panel. Each sidewall 92 has an elongated key 96 extending from the rim toward the floor 94, the ends of each key 97 precisely sized to closely receive a corresponding shouldered guide 47 in notch 46 on the probe connector body 26. The length of the notches 46 in body 26 are oversized so that the keys 96 do not bottom out in the notches 46 before the BMA connector is fully connected, as will be discussed below. In addition, the depth to which each notch 46 is recessed below the plane of the sidewall 42, 44 in which it is formed is slightly excessive, to provide adequate clearance. The receptacle 22 further includes notches 98 formed in the top and bottom of the rim 90 that mate with the keys 50 on the body 26. The widths of the shouldered guides 47, key ends 97, keys 50 and notches 98 are closely controlled so that precise positioning of the body relative to the receptacle rim is provided in both the vertical and horizontal directions even if the overall dimensions of the body and receptacle are not as narrowly constrained.

Figure 5:
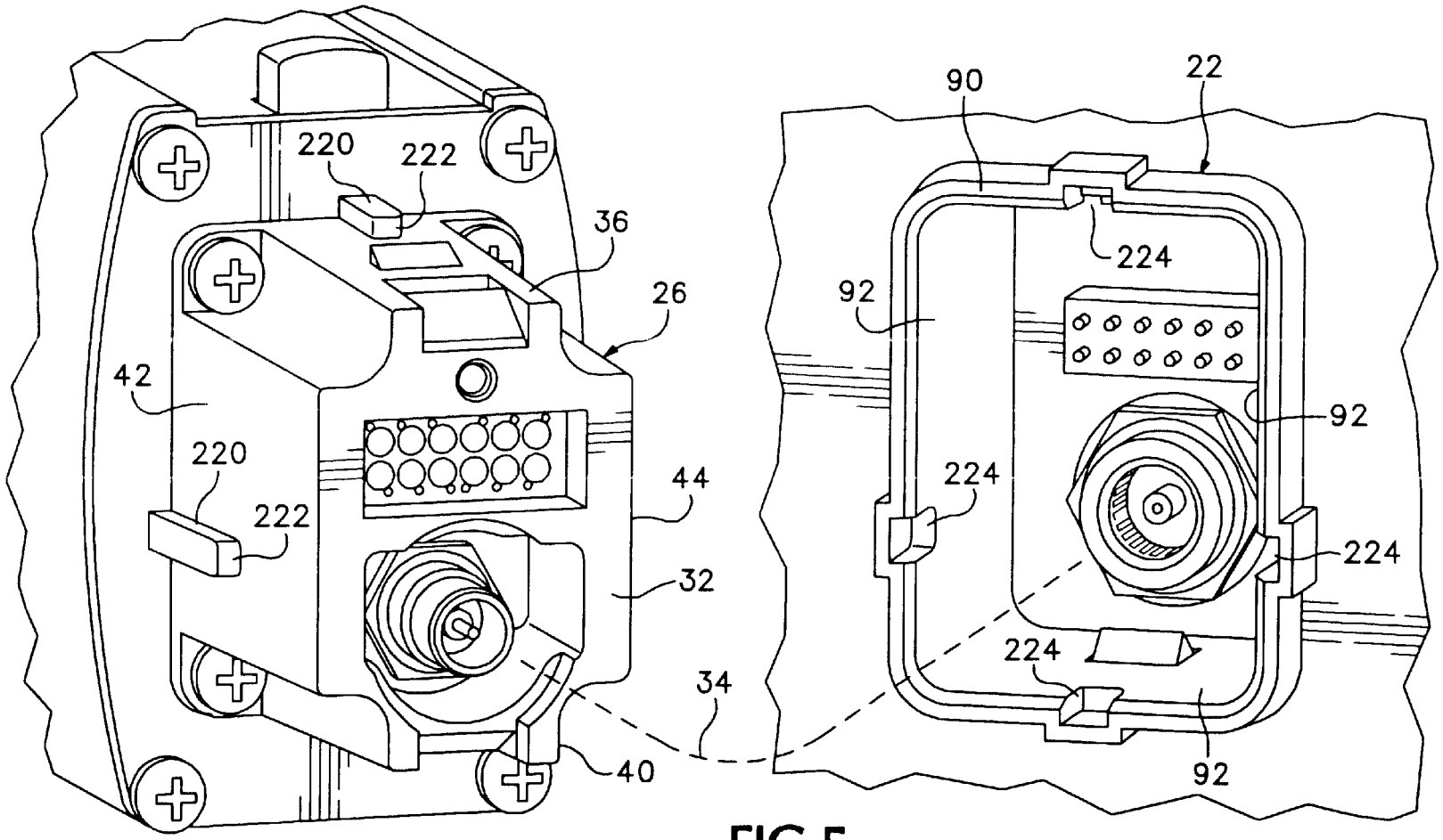
FIG. 5 is a perspective view of the probe and chassis interconnect with an alternate notch and rib configuration.

The keys and notches in the receptacle and body may be reversed as shown in FIG. 5. The body 26 includes an alignment key 220 on each major face 36, 40, 42, 44 of the body. Each key has an elongated rectangular profile, and extends parallel to the axis 34. The keys are manufactured to close size tolerances so that they closely fit corresponding notches as will be discussed below. The keys are registered with each other so that the leading ends 222 of all keys are equally spaced apart from the nose face 32. Each sidewall 92 of the receptacle 22 defines an elongated notch 224 at the rim 90, each notch precisely sized to closely receive a corresponding key 220 on the probe connector body 26. The length of each notch 224, that is, the depth to which is extends into the receptacle chamber, is oversized so that the keys 220 do not bottom out in the notches 224 before the BMA connector is fully connected, as will be discussed below. In addition, the depth to which each notch 224 is recessed below the plane of the wall in which it is formed is slightly excessive, to provide adequate clearance. Like the previously described embodiment, the widths of the notches and keys are closely controlled, so that precise positioning of the body relative to the receptacle rim is provided even if the overall dimensions of the body and receptacle are not as narrowly constrained. In other embodiments, each side may have both notches and keys, with the other having an opposite set of corresponding elements.

Thus, the notch and key arrangement permits insertion and extraction along the axis 34, but constrains lateral translation in the two degrees of freedom defined by the front panel plane 24, as well as the rotational degree of freedom about the axis. The remaining translational degree of freedom (along the axis) is constrained by the latching mechanism, and the remaining rotational degrees of freedom (lateral and horizontal bending of the probe connector body from normal to the front panel) are constrained by the connected BMA connector, as will be discussed below.

Figure 4:
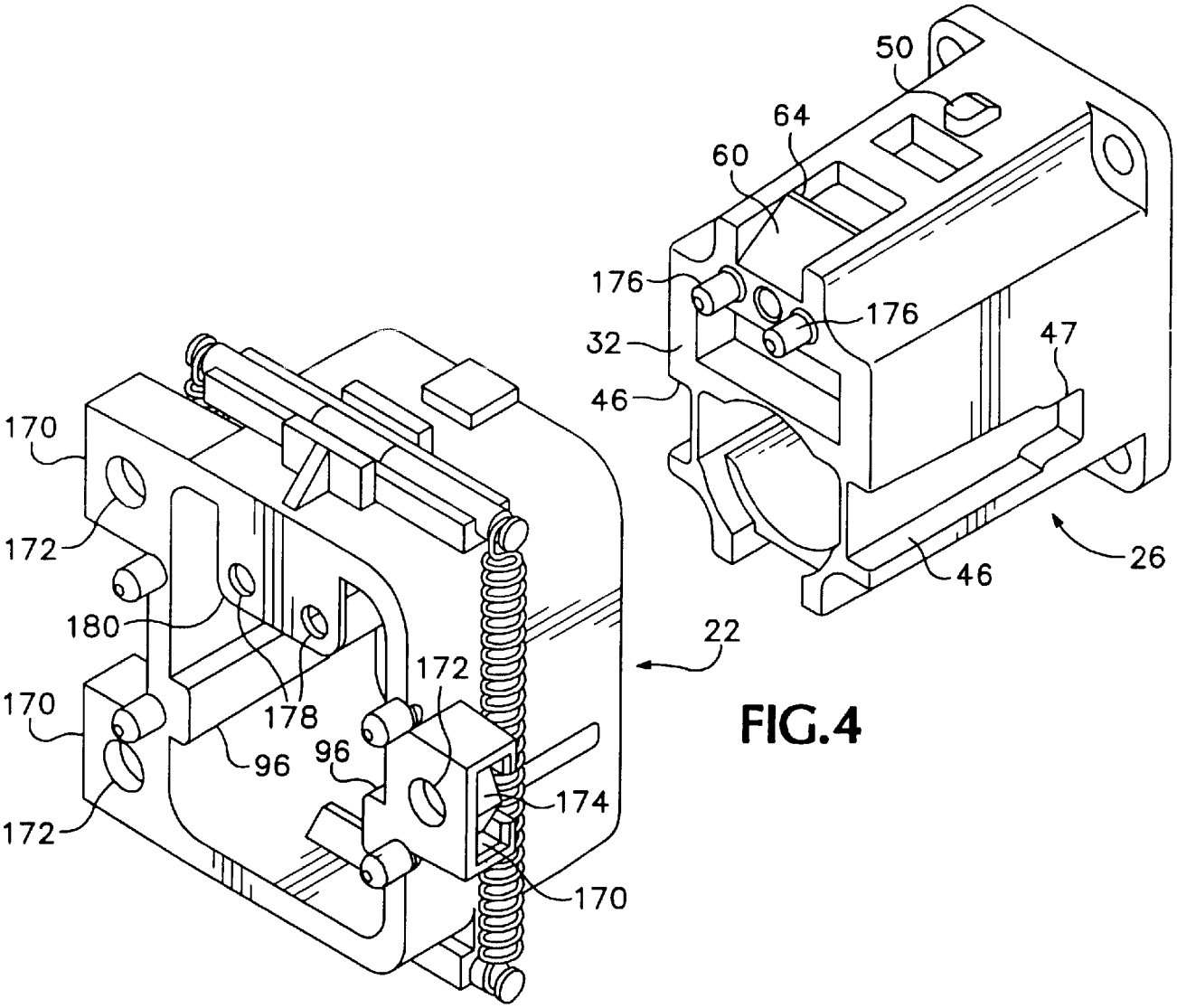
FIG. 4 is a reverse perspective view of the probe and chassis interconnects according to the embodiment of FIG. 1.

FIG. 4 shows representatively positioned protrusions 176 extending from the leading face 32 of the interconnect body 26 that mate with corresponding apertures 178 formed in a downward extending tab 180 formed in the receptacle 22. The protrusions 176 and apertures 178 permit the exclusion of incompatible probe connectors from improper connection with the instrument. The protrusions in the interconnect body 26 must have the corresponding aperture positions as the receptacle 22 for insertion to be permitted. While FIG. 4 show two protrusions and apertures, an array of protrusions and apertures may be formed in the interconnect body 26 and receptacle 22 to provide a family of interconnects having differing keying arrangements. The array of protrusions may be implemented with an array of apertures in the interconnect body 26 that accept elongated studs that extend past the leading face 32 of the body 26. The studs may be arranged in the array to produce a number of unique patterns. The array of apertures may be implemented in the tab 180 of the receptacle 22. Plastic inserts are inserted into apertures that do not correspond the to the stud arrangement of the protrusion array. Any interconnect body 26 having a stud arrangement that does not correspond to the aperture arrangement can not be electrically connected to an incompatible receptacle 22. The many possible positions of the protrusions and apertures, and the option of using a protrusion or aperture on either side of the connector, permits innumerable configurations to ensure that only the intended probes can be connected with a given receptacle.

An alternate configuration for the aperture array is to remove the tab 180 from the receptacle 22 and form the aperture array in the front panel 24 of the electronic instrument 10. The studs in the protrusion array extend into the apertures in the front panel 24. Plastic or metal inserts are inserted into the apertures in the front panel 24 to configure the array to the stud pattern of the protrusion array. As would be expected the studs in this configuration would be longer that those in the previously described configuration.

Returning to FIG. 3, a symmetrically opposed pair of spring loaded latches 100 protrudes into the receptacle chamber through openings defined in the upper and lower walls of the receptacle, in line with a vertical medial plane. Each latch has a roof shape with sloping faces rising to radiused apex ridges, with the slopes selected to match the surfaces of the latch ramps 62 on the body 26. The slopes are established to provide a lesser insertion force and a greater extraction force by using a gentler slope on the ramp surface 60 and corresponding latch surface than on ramp surface 62 and its corresponding latch surface. The radiused apexes and tight mechanical tolerances of the body/receptacle interface ensure that the latches do not reach a stable condition near the apex with one latch on the inserted side of the apex, and the other on the extracted side. Accordingly, the latches ensure that the connector is either fully connected, or adequately extracted to avoid undesirable partial electrical contact, as will be discussed below.

Figure 6:
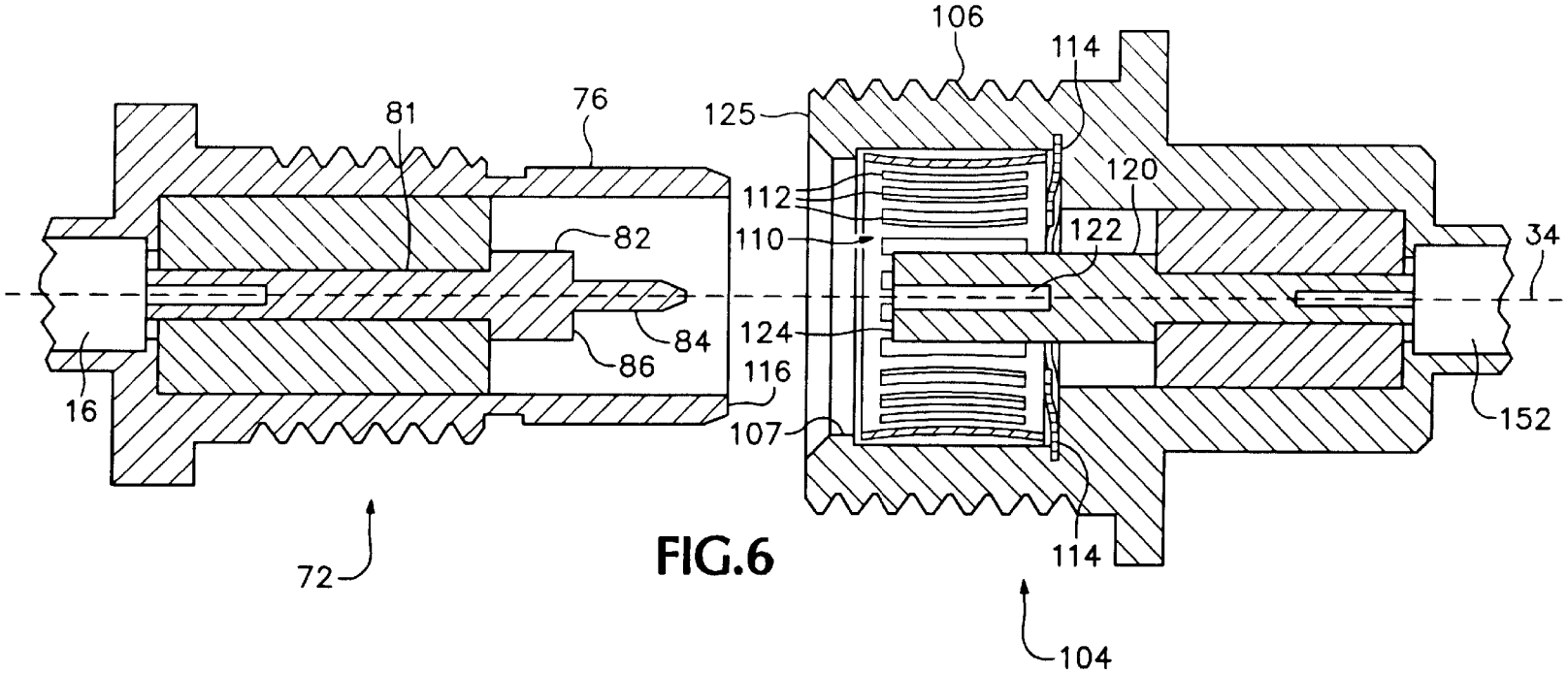
FIG. 6 is an enlarged sectional view taken along the axis of the connector.

There are two electrical connector components mounted to the floor 94 and within the receptacle, each component being the counterpart of a connector on the body. An array of spring loaded pogo pins 102 is positioned to register with the lands of the circuit board 70. The pins have a range of motion with suitable biasing force to accommodate the need that the BMA connector is free to establish the insertion depth of the connection. A female side 104 of the BMA connector is mounted to the floor panel 94, and is shown in greater detail in FIG. 6. The connector has a cylindrical sleeve 106 defining a cylindrical chamber 107.

The sidewalls and floor of the chamber are lined with a leaf spring sleeve 110 having side springs 112 bowing slightly into the chamber, and end spring portions 114 bowing into the chamber from the floor. The side springs compliantly grip the male shield portion 76, even if it were somewhat angularly displaced. For the BMA standard, displacements of up to 5 degrees are tolerated without degradation of the connection. However, such displacement may cause damage to the delicate springs as noted above. The end spring portions provide compliant contact with the end surface 116 of the male shield, tolerating a small range of insertion depths, so that the signal connection may establish the precise insertion depth. A central signal conductor 120 is a rigid sleeve having a bore 122 sized to closely receive the free end portion 84 of the male side conductor. Compliant spring portions (not shown) line the bore to prove effective ohmic contact.

The conductor 120 has a free end surface 124 that is recessed at adequate depth below the free end face 126 of the shield sleeve 106 to protect against damage. In addition, the sleeve extends to an adequate distance relative to the signal conductor to ensure that the shield contact is already made when the signal contact connects and is still made when the signal contact disconnects.

Inserting the body 26 into the receptacle 22 positions the keys 96 in the receptacle 22 into the notches 46 in the body 26. Continued insertion of the body 26 into the receptacle causes the male shield portion 76 to enter the female cylindrical chamber 107. The compliant side springs 112 grip the male shield portion 76 to align the free end portion 84 of the male signal conductor 81 to the bore 122 of the female central signal conductor. Continued insertion of the body 26 into the receptacle 22 engages the ends 97 of the keys 96 into the shouldered guides 47 of notches 46. Likewise, the keys 50 on the top and bottom of the body engage the notches 98 in the rim 90. The connector is fully inserted, as will be discussed below with respect to FIG. 8, when the shoulder 86 presses against the face 124 of the female signal conductor. With the shoulder 86 pressed against the face 124 of the female signal conductor, the end surface 116 of the male shield depresses the end spring portions 114 of the leaf spring sleeve 110. The spring latches provide this biasing force.

Figure 7:
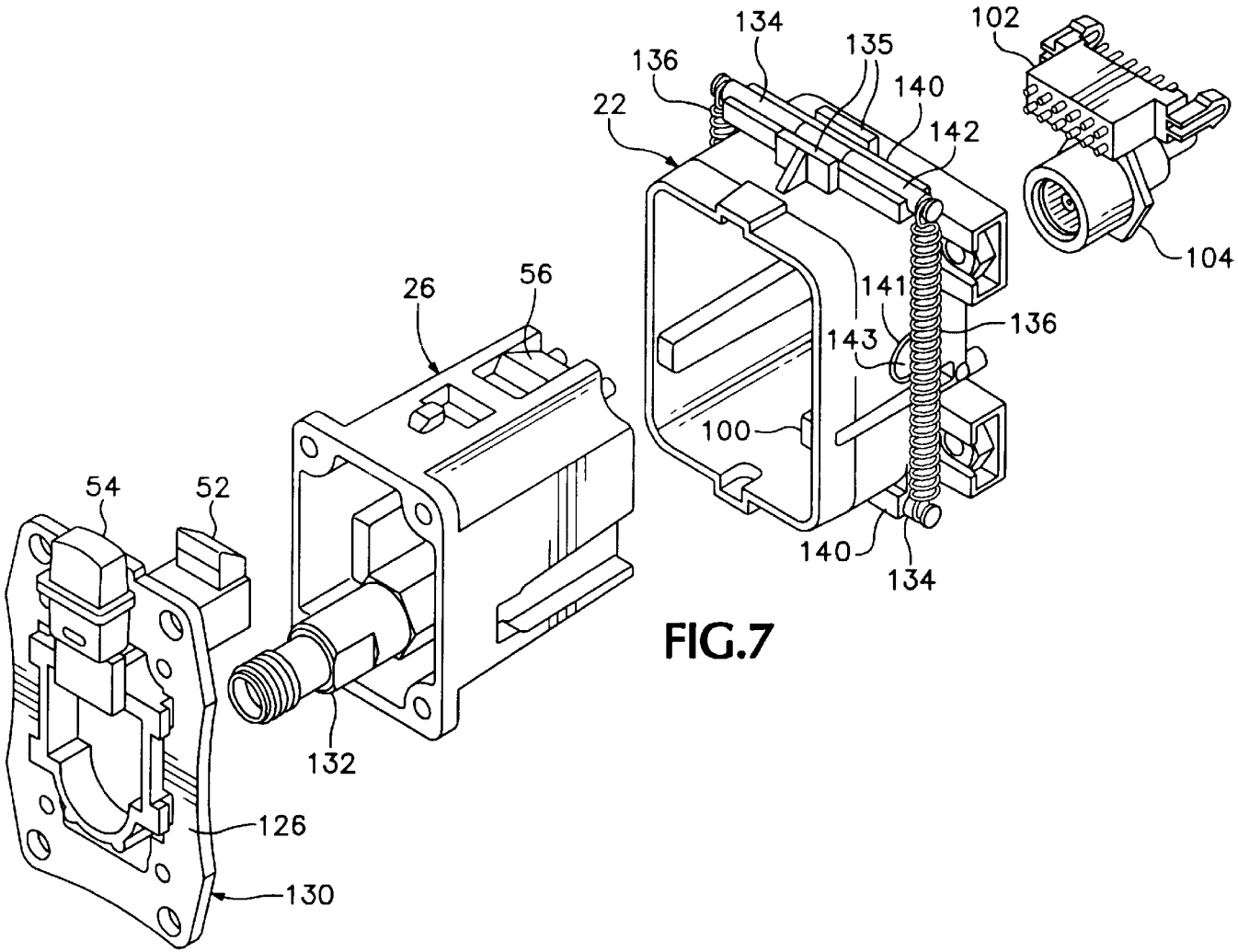
FIG. 7 is an exploded view of the interconnect of FIG. 1.

FIG. 7 shows additional mechanical details, with the lock 52 and button 54 being connected to a lock frame 126, for sliding with respect to a housing end plate 130 that is mounted to housing 20, and to which body 26 is mounted. A rear end 132 of the male side of the BMA connector 72 passes through a hole in the plate, so that it extends into the housing 20 for connection to circuitry in the housing or to the cable. The rear end is illustrated with a standard SMA threaded connector, although any type may be employed, including BNC, BMA, N, or any high frequency capable connector. The latch ramp 56 is shown, illustrating the different slopes needed to provide a greater extraction force than insertion force.

The spring latches 100 are each mounted to an elongated bar 134. Each bar extends slightly more than the width of the receptacle, with one bar positioned above the upper wall, and the other below the lower wall. The bars are positionally constrained by channel walls 135 extending from the receptacle's upper and lower surfaces. A coil tension spring 136 is positioned on each side of the receptacle, with the ends of each spring connected to the extending ends of the bars to bias the bars together. With the bars thus biased, the latches are biased toward each other. In the preferred embodiment, the latches are plastic, and integral with elongated plastic beams 140 that receive the metal reinforcing bars 142. Alternately, fixed spring retention surfaces may be defined over the latches 100 with compression springs captured between the spring retention surfaces and the latches 100. A recess 141 is formed in the receptacle sidewalls behind each spring 136 that contains a high density foam insert 143, such as manufactured and sold by Rogers, Corp., East Woodstock, Conn., under the trade name Poron. The inserts 143 dampen excess spring noise during the insertion and removal of the body 26 into the receptacle 22.

Figure 8:
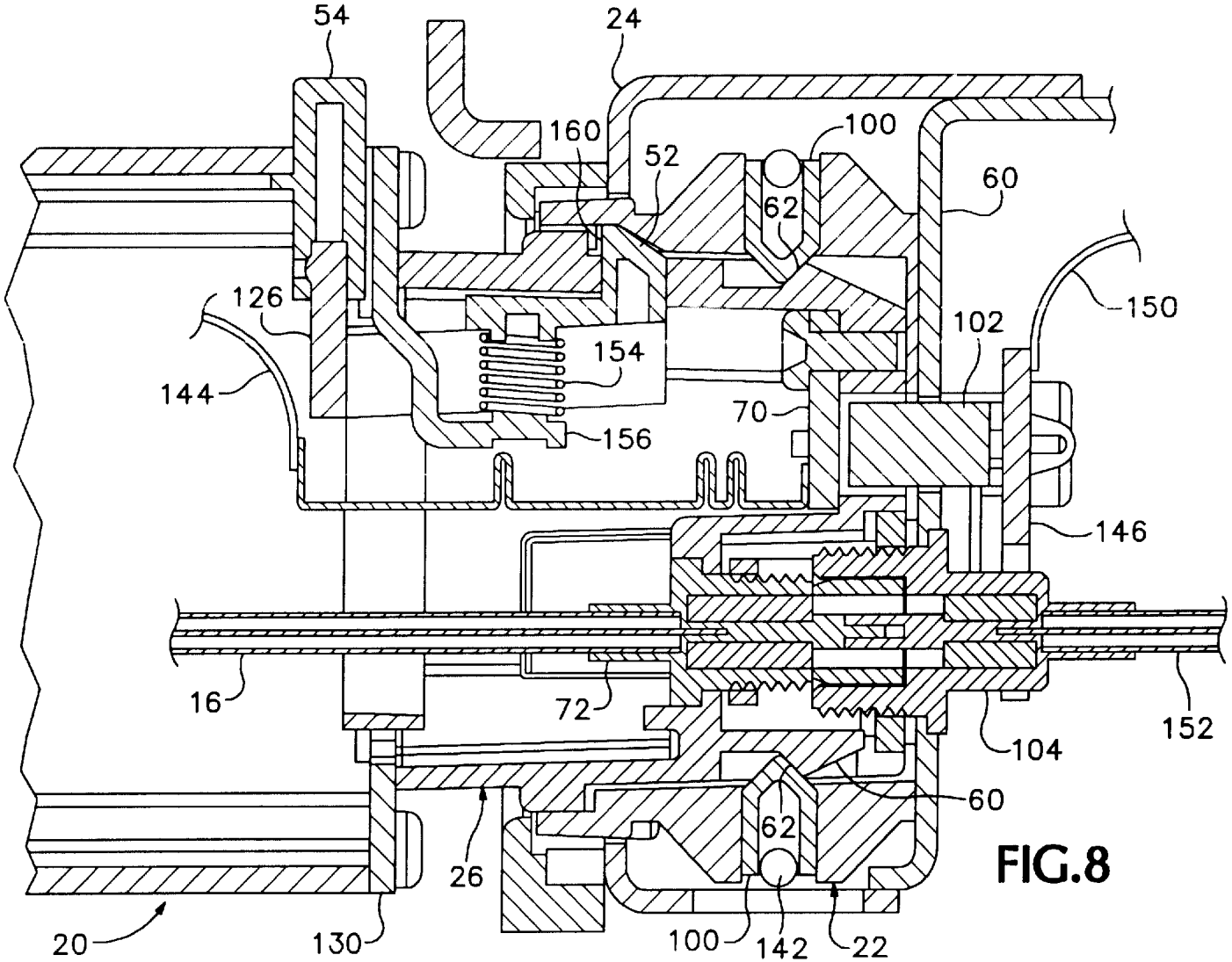
FIG. 8 is a sectional side view of the interconnect of FIG. 1 taken along a medial line.

FIG. 8 shows the connector in a fully inserted condition. An interconnect cable 144, preferably a flex circuit, is connected to the circuit board 70, which is mechanically secured to the body by a screw, staking or the like. The data and power cable are connected to circuitry (not shown) in the probe interconnect housing 20. The pogo pin connector 102 has fixed leads extending into the instrument, and to which a circuit board 146 is soldered, with an extending data cable 150 connected to circuitry in the instrument 10. Alternately, the pogo pin connectors 102 may be soldered directly to a front panel circuit board. The probe cable 16 is connected to the male side 72 of the BMA, which is shown with the shoulder fully abutting the face of the female signal conductor. An instrument signal cable 152 is connected to the rear of the female side 104, and connects to circuitry in the instrument. To bias the shoulder 84 of the male side of the BMA against the female face 124, the latches are arranged so that the latches do not bottom out against the flat surface of the body, but are pressing on the sloped ramp surface. This generates the axial biasing force needed to ensure a suitable high frequency connection.

The spring bias on the lock frame 126 is provided by a coil compression spring 154 that is captured between a portion of the lock frame and a fixed arm 156 extending axially from the plate 130. A notch 160 is engaged by the lock to prevent accidental extraction. The lock mechanism is independent from the latch mechanism. That is, the combination of the latch ramps 60 and 62 on the interconnect body 26 with the spring latches 100 on the receptacle 22 provide adequate latching force to secure the interconnect body 26 within the receptacle 22 without the need for the lock 52 and button 54. The lock mechanism is provided in the preferred embodiment as a secondary protection against accidental removal of the probe interconnect housing from the electronic instrument 10. The lock design is also unique in that it has a "fail safe" feature. If the user tries to remove the device without pushing the lock button, the lock design is such that it will "cam out" and the device will release before there is damage to the lock or retention mechanism. This is in part controlled by the ramp angle on the front face of the movable portion of the lock mechanism. Depending on the probe application, the locking mechanism may not be used in the probe interconnect housing.

Figure 9A:
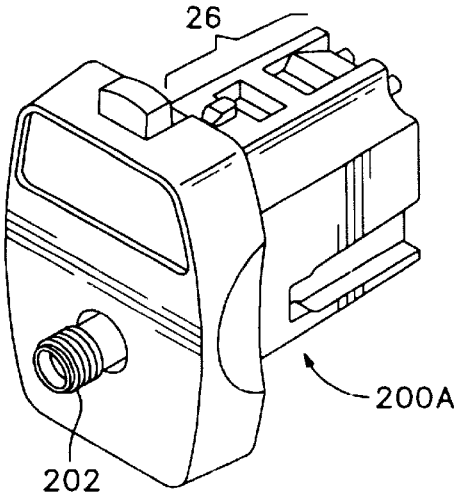
FIGS. 9A–9D are perspective views of connector adapters compatible with the interconnect of FIG. 3.
Figure 9B:
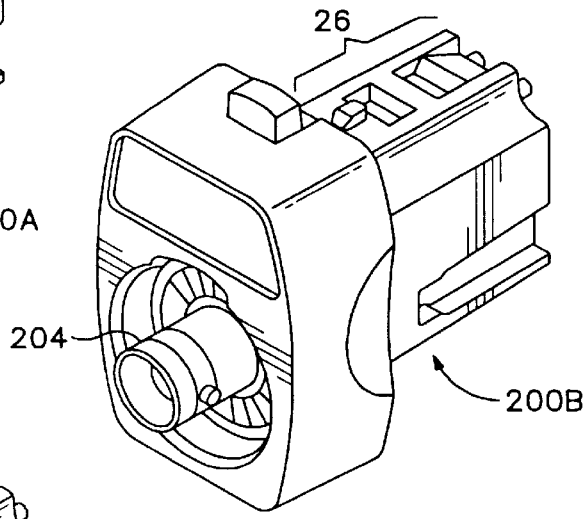
Figure 9C:
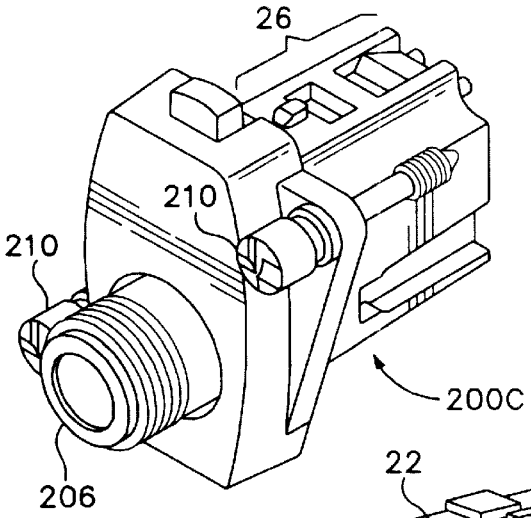

FIGS. 9A, 9B, and 9C show different connector adapters 200A, 200B, 200C configured to interface standard connectors to the custom connector receptacle described above in the preferred embodiment. These permit a generic probe or other circuit under test connecting device not designed for the instrument to provide a signal to the instrument. In particular, because the high frequency connector is a BMA type unsuited for a probe without other support against bending and accidental extraction, other connector types are needed. Each adapter includes a standard male body 26 with the same male BMA connector, latches and optional lock as in the preferred embodiment. The illustrated adapters may not need the additional data lines, so the board 70 need not be connected to a cable 144 as in the preferred embodiment. However, because the instrument may include fail-safe measures to ensure against operation without a connector properly installed, the board may be provided with a selected connection between two or more lands or via information stored in an EPROM or other non volatile memory contained with the adapter, thereby indicating to the instrument that a proper connector is in place.

Adapter 200A has a female SMA connector input 202, much as if the preferred embodiment had the housing 20 replaced by a more compact housing, and the cable connection to the BMA male side 72 eliminated. Adapter 200B has a female BNC connector input 204, and could also include power and data interfaces for backward compatibility to support existing single or multi-line connector configurations, such as employed in the P6139A and P6245 measurement probes manufactured and sold by Tektronix, Inc. Beaverton, Oreg. Adapter 200C has a female N connector input 206. To provide a more robust connection to the instrument when a heavy cable is to be connected, such as to an N connector, a pair of optional thumbscrews 210 are provided to mate with tapped holes or PEM® nuts in the instrument front panel. In the preferred embodiment, the male BMA connector is a custom screw machine part having sufficient length to position the various connectors at the housing surface. Alternately, a standard BMA connector with an SMA connector end may be used with the various adapter connectors, such as SMA to BNC connectors, SMA to N connectors, and the like.

To avoid excessive torque that may damage the front panel, the thumbscrews 210 have camming surfaces that prevents use of a screwdriver for insertion. These screws permit the use of a tool for extraction, such as may be needed if the fastener becomes frozen, or if a user with limited dexterity or strength needs to extract the screws. Such screws are different from those normally employed to prevent vandalism and dismantling of public structures such as rest room stalls, in that they operate in reverse, facilitating tool-aided extraction, but preventing tool-aided securement.

Figure 9D:
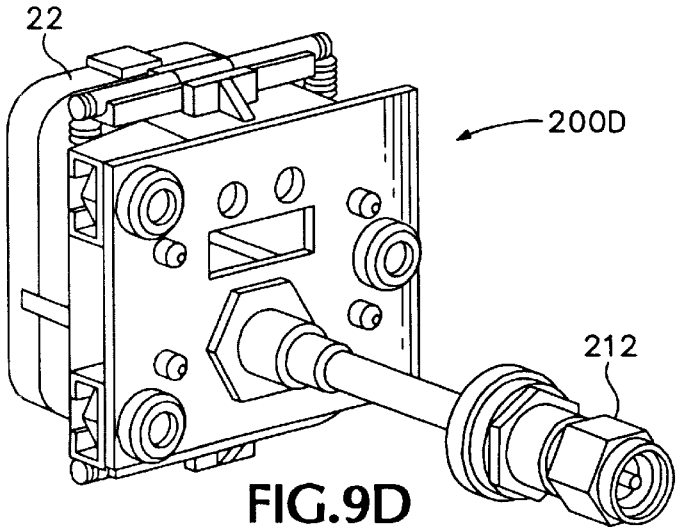

In FIG. 9D, an adapter 200D provides for conversion of a probe designed for the preferred embodiment for use with an instrument with a generic input such as BNC, SMA, or N. The adapter uses the female side of the preferred embodiment, but without being chassis mounted. A conventional male connector 212 extends from the rear of the connector. Alternatively, a female connector may be provided, so that a male cable end may connect between the adapter and an instrument input. Although shown with springs and latch bars exposed for clarity, in the preferred embodiment a shroud would surround these components to prevent damage and to provide a sleek appearance.

Figure 10:
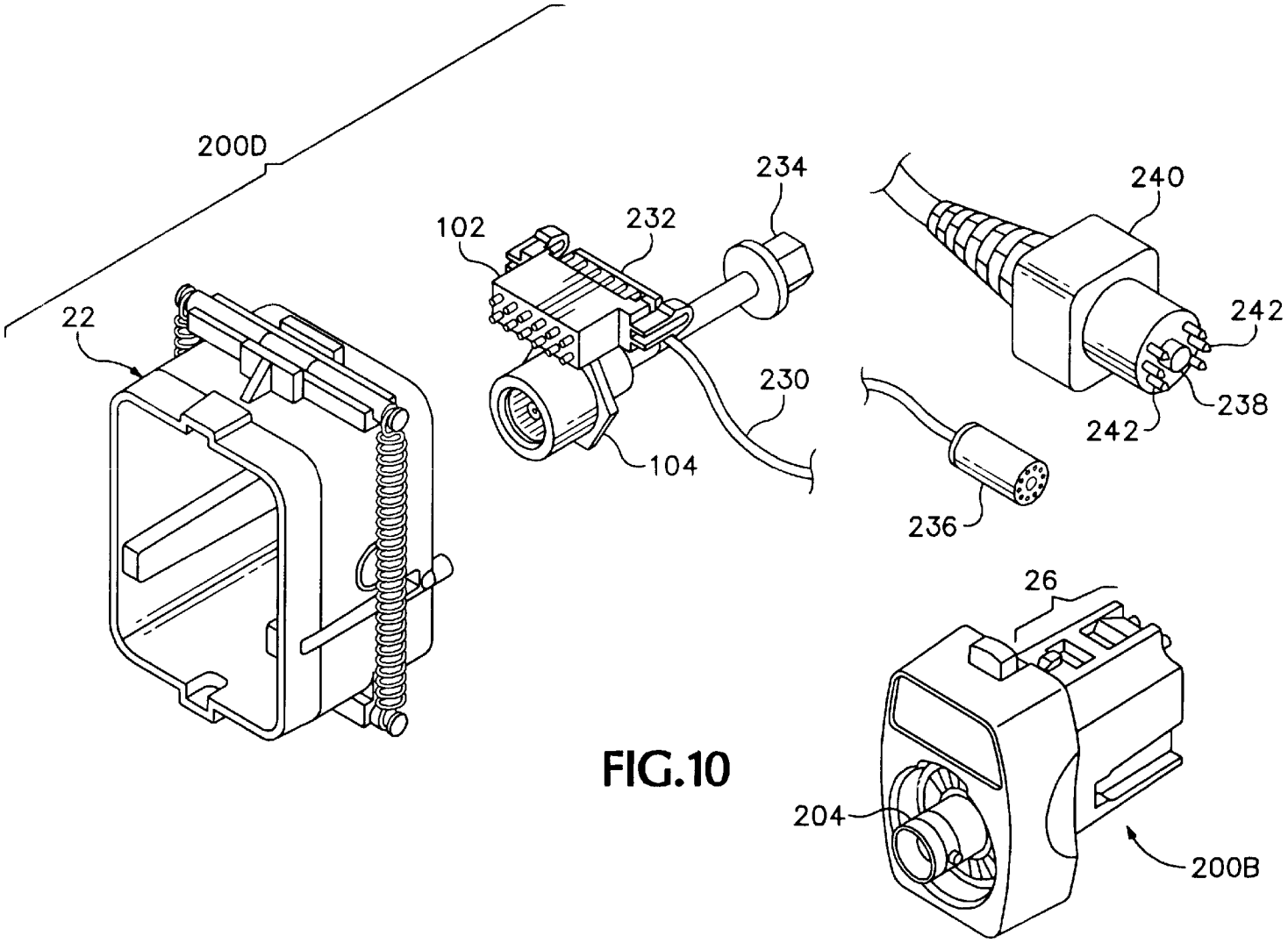
FIG. 10 is a perspective view of a powered connector adapter for connecting an end device compatible with the interconnect of FIG. 3 to a measurement instrument having a noncompatible interconnect.

Referring to FIG. 10, there is shown an exploded perspective view the adapter 200D of FIG. 9D modified with a transmission cable 230 for providing, at a minimum, voltage power to the adapter. The transmission cable 230 has individual electrical lines that are connected to respective contacts of an electrical interconnect, such as a circuit board 232. The circuit board contacts are electrically coupled to fixed leads extending from pogo pin connectors 102 in the receptacle portion 22 of the electronic interconnect assembly. The center signal conductor and the surrounding shield conductor of the BMA connector 104 in the receptacle 22 are connected to the corresponding center signal conductor and shielding conductor of the electrical signal conductor 234, such as a SMA or precision BNC connector. The other end of the transmission cable is connected to a second electronic interconnect adapted for the particular voltage power interface available for use. For example, the second electronic interconnect may be a DIN type connector 236 that mates with a corresponding DIN connector in the measurement instrument. Another type of interconnect may be a previously described BNC type connector 238 with a connector housing 240 supporting several pogo pins 242 extending outward from the housing 240 adjacent to the connector 238. The BNC connector mates with a corresponding BNC connector on the measurement instrument with the pogo pins 242 contacting conductive lands on the measurement instrument. Voltage power is coupled to the lands from the instrument. The BNC type connector with the pogo pin contacts may also be connected to the input connector 204 adapter 200B as shown in FIG. 9B. The body 26 of the adapter 200B is inserted into the receptacle 22 of the electronic interconnect mounted on a measurement instrument with the lands of the circuit board 70 in the body 26 mating with spring loaded pogo pins 102 in the receptacle 22.

Figure 11:
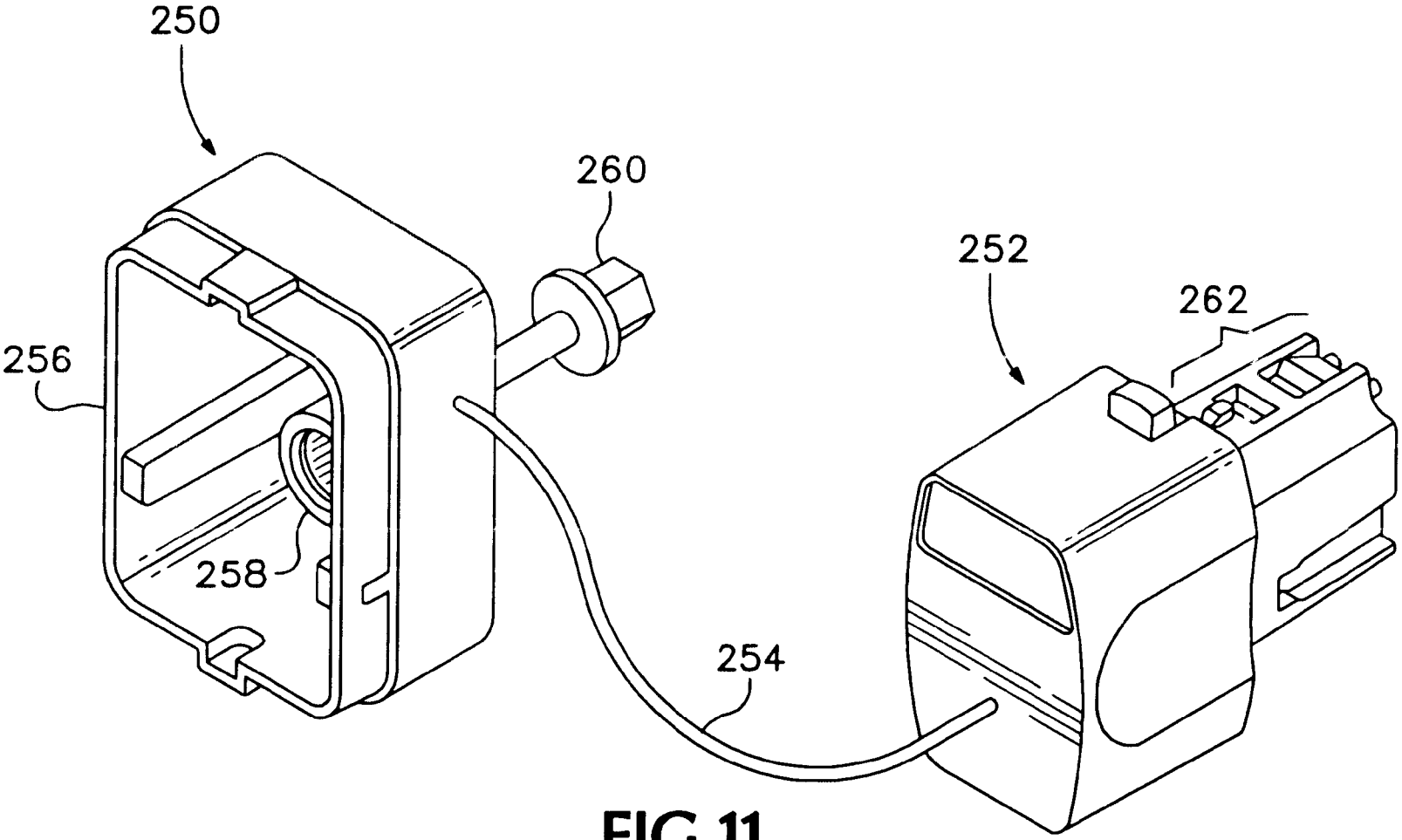
FIG. 11 is a perspective view of a end device calibration adapter for connecting an end device compatible with the interconnect adapter of FIG. 3 to a measurement instrument having a noncompatible interconnect.

There is a further need to connect an end device, such as a measurement probe, to a measurement instrument that does not have the electronic interconnect of the present invention to verify the end device performance. For example, the probe may need to be connected to a high bandwidth sampling oscilloscope to verify the bandwidth/risetime of the probe and allow changes to be made to parameter data stored in an EEPROM in the probe. FIG. 11 illustrates an adapter having a first adapter portion 250, as illustrated in FIG. 10, connected to a second adapter portion 252 via the transmission line 254. The transmission line 254 includes data lines for passing data between a host instrument having the electronic interconnect and the probe having the electronic interconnect. The body portion of the probe interconnect is connected to the receptacle portion 256 of the first adapter 250. The BMA connector 258 in the receptacle portion 256 is connected to an electrical signal conductor 260 having characteristics that emulate as close as possible the characteristics of the BMA connector. One such connector is an SMA connector. The electrical signal conductor is connected to a corresponding connector on the measurement instrument. The second adapter portion 252 includes the body portion 262 of the electronic interconnect and is connected to the receptacle portion of the host measurement instrument. The host instrument communicates with the probe through the adapters and transmission cable via the data lines. Probe data stored in the probe EEPROM, such as calibration constants and calibration date, may be read and changed through the host measurement instrument.

While the disclosure is made in terms of a preferred embodiment, the invention is not intended to be so limited. For instance, the electrical connectors may be positioned on different sides of the connector. Having the pogo connector on the instrument side reduces the risk of damage that might occur if it were mounted on the probe side, due to the possibility of probes being subject to damage by dropping or contact with other hardware in a drawer. However, the pogo connector may be on the probe side if there is a concern that the pogo connector may require service or replacement, which is more practical with a probe than with an instrument. Similarly, the male and female sides of the BMA may be reversed, should usage needs dictate. The pogo and BMA connectors may be mounted in either configuration, independent of each other.

While the invention is illustrated with a fixed female BMA connector, it is possible to use a floating or spring loaded connector component for embodiments having a single or multiple BMA connections on a single probe connector housing, to accommodate positional variations between connectors on the housing. However, this would require a flexible cable loop to each floating BMA in the instrument housing, complicating internal wiring of the instrument, and potentially causing motion-induced fatigue or damage where the instrument cable connects to other circuitry. Accordingly, it is preferable for single BMA connectors to use a fixed connector on the instrument.

The key and notch alignment facility is intended to provide accurate alignment with a wobble of less than 0.5 degree being tolerated. This is adequate to provide nominal signal performance with a BMA connector, and to guard against damage by excessive displacement. While it is possible to achieve tighter tolerances, there is an advantage to allowing some minimal wobble, as it provides needed "scrubbing" of the pogo pins against the lands upon connection, providing a low resistance contact, and removing or wearing through any debris or high resistance layer on the lands. The key and notch facility may be totally eliminated with moderate and tolerable increases in wobble, about 1–2 degrees. While a more precise alignment is desirable for a quality feel, and for a uniform appearance when multiple connectors installed in an instrument, there is security in having adequate alignment even if a key or notch were damaged or missing.

The illustrations of the preferred embodiment are made with respect to BMA connectors, although some principles of the invention are applicable with any connector type. Other principles of the invention are applicable with any coaxial high speed connector lacking a screw down attachment, or having a compliant contact sleeve, or having insertion-depth-sensitive conductors such as a shoulder contact, or any connector not intended to provide support against lateral bending loads.

What is claimed is:

1. An adapter for an electronic interconnect assembly comprising:

a high speed coaxial interconnect having a central signal conductor and a surrounding shield conductor, the coaxial interconnect having a male side and a female side;

the female side including a shield sleeve defining a chamber for receiving a male shield contact on the male side;

the shield sleeve including a contact facility having a compliant portion operable to flexibly grip the male shield contact;

a mechanical alignment facility portion selected from a pair of coarse mechanical alignment portions comprising a pocket and a closely mating body wherein the pocket has a rim and a floor recessed below the rim, and wherein one side of the interconnect is connected to the floor, such that the rim provides a first angular displacement limit of the body, and a fine mechanical alignment portion including a notch defined in one of the pocket and body and a key closely mating with the notch defined in the other of the pocket and body such that the notch provides a second angular displacement limit of the body with one of the male side and female side of the interconnect selected and connected to the selected mechanical alignment facility portion;

an electrical signal connector having a central signal conductor and a surrounding shield conductor connected to the selected mechanical alignment facility portion and electrically coupled to the respective central signal conductor and surrounding shield conductor of the selected coaxial interconnect side;

an electrical data interconnect portion connected to the selected mechanical alignment facility portion selected from a pair of electrical data interconnect portions comprising compliant contacts and fixed surface contacts; and a transmission cable having one or more voltage supply lines electrically connected to the electronic data interconnect.

2. An adapter for an electronic interconnect assembly comprising:

a high speed coaxial interconnect having a central signal conductor and a surrounding shield conductor, the coaxial interconnect having a male side and a female side;

the female side including a shield sleeve defining a chamber for receiving a male shield contact on the male side;

the shield sleeve including a contact facility having a compliant portion operable to flexibly grip the male shield contact;

a first mechanical alignment facility portion selected from a pair of coarse mechanical alignment portions comprising a pocket and a closely mating body wherein the pocket has a rim and a floor recessed below the rim, and wherein one side of the interconnect is connected to the floor, such that the rim provides a first angular displacement limit of the body, and a fine mechanical alignment portion including a notch defined in one of the pocket and body and a key closely mating with the notch defined in the other of the pocket and body such that the notch provides a second angular displacement limit of the body with one of the male side and female side of the interconnect selected and connected to the selected first mechanical alignment facility portion;

an electrical signal connector having a central signal conductor and a surrounding shield conductor connected to the selected first mechanical alignment facility portion and electrically coupled to the respective central signal conductor and surrounding shield conductor of the selected coaxial interconnect side;

a first electrical data interconnect portion connected to the first selected mechanical alignment facility portion selected from a pair of electrical data interconnect portions comprising compliant contacts and fixed surface contacts;

a second mechanical alignment facility portion selected from the other coarse mechanical alignment portion with the other coaxial interconnect side selected and connected to the selected second mechanical alignment facility portion;

a second electrical data interconnect portion connected to the second mechanical alignment facility portion selected from the other electrical data interconnect portion and electrically coupled to the first electrical data interconnect portion via and transmission cable.

3. The apparatus of claim 2 wherein the first and second mechanical alignment facility portions include a latch facility with the pocket mechanical alignment portion having a pair of spring loaded latches positioned on opposite sides of the pocket with each latch having an apex, and the body mechanical alignment portion having a pair of latch ramps positioned on opposite sides of the body with each latch ramp having a front sloping surface and a reverse sloping surface forming an apex, the apex of the latches engaging the reverse slopes of the latch ramps, such that a symmetrical biasing force is provided.

4. The apparatus of claim 2 wherein the interconnect is a blind mating interconnect.

5. The apparatus of claim 2 wherein the electrical signal connector is a BNC connector selected from a male connector and a female connector.

6. The apparatus of claim 2 wherein the electrical signal connector is a SMA connector selected from a male connector and a female connector.

7. The apparatus of claim 2 wherein the electrical signal connector is a N type connector selected from a male connector and a female connector.

8. The apparatus of claim 2 wherein the assembly includes only a single high speed interconnect.

9. The apparatus of claim 2 including an electronic instrument having an electrical signal connector electrically connected to circuitry in the instrument that mates with the electrical signal connector on the mechanical alignment facility portion.

10. The apparatus of claim 9 wherein a coaxial transmission cable connects the electrical signal connector of the electronic instrument to the electrical signal connector of the mechanical alignment facility portion.

11. The apparatus of claim 2 wherein the compliant contacts include movable spring biased contacts.

12. The apparatus of claim 11 wherein the movable spring biased contacts are pogo pins.

13. An electronic interconnect assembly adapter for a measurement probe comprising:

a high speed coaxial interconnect having a central signal conductor and a surrounding shield conductor with the coaxial interconnect having a male portion and a female portion;

the female portion including a shield sleeve defining a chamber for receiving a male shield contact on the male side;

the shield sleeve including a contact facility having a compliant portion operable to flexibly grip the male shield contact;

a pocket mechanical alignment portion selected from a pair of coarse mechanical alignment portions comprising the pocket and a closely mating body wherein the pocket has a rim and a floor recessed below the rim, and wherein one side of the interconnect is connected to the floor, such that the rim provides a first angular displacement limit of the body, and a fine mechanical alignment portion including a notch defined in one of the pocket and body and a key closely mating with the notch defined in the other of the pocket and body such that the notch provides a second angular displacement limit of the body with the female side of the interconnect connected to the pocket mechanical alignment portion; and an electrical signal connector having a central signal conductor and a surrounding shield conductor connected to the pocket mechanical alignment portion and electrically coupled to the respective central signal conductor and surrounding shield conductor of the female side of the interconnect;

a first electrical data interconnect portion connected to the pocket mechanical alignment portion having compliant contacts;

a body mechanical alignment portion selected from the other coarse mechanical alignment portion with the male side of the coaxial interconnect connected to the body mechanical alignment portion;

a second electrical data interconnect portion connected to the body mechanical alignment portion having fixed contact surfaces with the fixed contacts electrically coupled to the compliant contacts of the first electrical data interconnect portion via a transmission cable.

* * * * *